US007944138B2

(12) United States Patent
Iizawa et al.

(10) Patent No.: US 7,944,138 B2
(45) Date of Patent: May 17, 2011

(54) FLUORESCENT DISPLAY TUBE

(75) Inventors: Takehiro Iizawa, Chiba (JP); Shinichi Narushima, Chiba (JP); Katsushi Tokura, Chiba (JP); Yukihiko Shimizu, Chiba (JP); Klaus Heynen, Chiba (JP)

(73) Assignee: Futaba Corporation, Mobara-shi, Chiba (JP)

( * ) Notice: Subject to any disclaimer, the term of this patent is extended or adjusted under 35 U.S.C. 154(b) by 58 days.

(21) Appl. No.: 12/614,558

(22) Filed: Nov. 9, 2009

(65) Prior Publication Data

US 2010/0117515 A1 May 13, 2010

(30) Foreign Application Priority Data

Nov. 10, 2008 (JP) ..... 2008-287715

(51) Int. Cl.
*H01J 19/42* (2006.01)
*H01J 1/88* (2006.01)

(52) U.S. Cl. ..... 313/495; 313/278; 313/272

(58) Field of Classification Search ..... 313/495–497, 313/271, 272, 278, 269, 292, 422
See application file for complete search history.

(56) References Cited

FOREIGN PATENT DOCUMENTS

| | | |
|---|---|---|
| JP | 63-18750 A | 2/1988 |
| JP | 02-5872 H | 1/1990 |
| JP | 09-147766 | 6/1997 |

OTHER PUBLICATIONS

Fluorescent Display Tube, Sangyo-Tosho, Oct. 1990, pp. 19-21.

*Primary Examiner* — Joseph L Williams
(74) *Attorney, Agent, or Firm* — Quarles & Brady LLP

(57) ABSTRACT

A fluorescent display tube, which has short-length filaments, can be driven by applied voltage of 3-8V to be used for a general fluorescent display tube. The fluorescent display tube can emit sufficient thermal electrons even if the number of filament cathodes is decreased to reduce power consumption of the filaments. The filament cathode is arranged between a first and third supporting plates by one end thereof fixed to the first supporting plate and the other end thereof fixed to the third supporting plate, and the filament cathode having an equal length with the filament cathode extended between the first and third supporting plates is arranged between the second and third supporting plates.

7 Claims, 7 Drawing Sheets

FLUORESCENT DISPLAY TUBE

CROSS-REFERENCE TO RELATED APPLICATIONS

This application claims priority to Japanese Patent Application Number 2008-287715 filed on Nov. 10, 2008, the contents of which are fully incorporated herein by reference.

STATEMENT REGARDING FEDERALLY SPONSORED RESEARCH

Not Applicable.

BACKGROUND

1. Field of the Invention

The present invention relates to a filament supporting structure of a fluorescent display tube having an anode plate with phosphor segments and filament cathodes inside an airtight container.

2. Description of Related Art

A reduction in power consumption of a fluorescent display tube has been demanded. To that end, filament cathodes are divided into blocks and are driven separately for each block so that current is not carried to the filament cathodes corresponding to a non-displaying region.

A fluorescent display tube, shown in FIG. 7, is a light emitting device including an airtight container which is provided therein with an anode substrate having phosphor segments 130, 131 made of electron-excited phosphors formed on an insulating substrate, a front plate and side plates, all of which are sealed in the airtight container by low-melting-point glass, and inside the container is provided with filament cathodes 430, 431 which emit thermal electrons so the phosphors emit light when receiving the thermal electrons.

Another example of the fluorescent display tube includes a grid electrode between the phosphors 130, 131 and the filaments 430, 431, and performs acceleration control of the thermal electrons emitted from the filaments 430, 431.

Japanese Utility Model Publication Number H02-5872 discloses a fluorescent display tube having the filaments 430, 431 divided into several blocks and extended across the container, so a voltage can be applied separately to filaments for each block.

The filament cathodes extending within the airtight container are tungsten wires having a diameter of for example about 14.6 μm coated with electron emitting substance layer composed of ternary oxides (Ba, Sr, Ca)O.

During the use, the filament cathodes are heated to about 600 to 650° C. Therefore, in order to electrically heat the tungsten wires having diameter of about 14.6 μm, voltage of 3 to 6V is applied so current of about 25 mA flows through each filament cathode (refer for example to non-patent literature, "Fluorescent Display Tube, published by Sangyo-Tosho, October 1990, p. 19-21").

In conventional art, for example Japanese Patent Publication Number H09-147766 discloses providing two cathode-supporting plates on each end of a rectangular anode substrate. The cathode-supporting plate is an elongated plate and is arranged so as a longitudinal direction thereof is perpendicular to a longitudinal direction of the filament cathode (a longitudinal direction of the anode substrate). The cathode-supporting plates are arranged in the longitudinal direction of the anode substrate with a space. The cathode-supporting member is fixed to a supporting plate composed of 426 alloy (composed of 42% of Ni, 6% of Cr and the rest is Fe alloy) with a thermal expansion coefficient close to that of glass. Each filament cathode is tensioned by one end thereof attached to the cathode-supporting member and the other end thereof attached to an anchor member fixed to the supporting plate. The supporting plate can be guided outside the container where they are connected to a cathode driving circuit.

Furthermore, Japanese Utility Model Publication Number S63-18750 discloses a fluorescent display tube having heat-producing wires. Each heat-producing wire of an adjacent indirectly-heating-type cathodes has one end attached to the same metal supporting plate and each other end thereof is attached, respectively, to different and separate metal supporting plates connected to the wires of other adjacent cathodes. The wire ends of the outermost cathode not connected to the common metal supporting plates are attached to the metal supporting plates connected to external lead wires for electrical connection.

Since the filament cathode is structured by the tungsten wire, the magnitude of applied voltage is proportional to a length of the filament cathode. According to the conventional art, reduction in the size of the fluorescent display tube leads to shortening of the length of the filament cathodes. Therefore, while the voltage employed in a filament power source for a typical fluorescent display tube is about 3V, the voltage applied to the fluorescent display tube with short filament length is for example only about 2V, causing it to be difficult to handle.

In view of the above-described problem, an object of the invention is to provide a fluorescent display tube and a driving method thereof enabling a use of a filament power source with voltage of 3 to 8V and reducing current which flows through the filament cathode arranged to extend within the fluorescent display tube.

SUMMARY OF THE INVENTION

For achieving the above-described object, a fluorescent display tube is provided with a plurality of filament supporting plates and filament cathodes divided into two or more blocks in parallel, where the filament cathodes in each block can be electrically connected in series. Therefore, a voltage can be applied separately to each block, and current flows only through the filament cathodes within the block which needs thermal electrons.

For achieving the above-described object, a fluorescent display tube is structured with: an anode substrate including an insulation substrate having phosphor segments made of electron-excited phosphors formed on the insulating substrate; a front plate; and side plates, all of which are sealed in an airtight container by low-melting-point glass, where filament cathodes emitting thermal electrons to excite the phosphors to emit light are provided therein. The fluorescent display tube includes: a plurality of supporting plates arranged inside the airtight container, and the plurality of the supporting plates include: a first supporting plate; at least two second supporting plates arranged adjacent to the first supporting plate; and third supporting plates arranged so as to be spaced-apart from the second supporting plates, where the second supporting plates and the third supporting plates are same in number. One of the filament cathodes is arranged between the first supporting plate and the third supporting plate by one end thereof fixed to the first supporting plate and the other end thereof fixed to the third supporting plate. The other of the filament cathodes having an equal length with the filament cathode arranged between the first supporting plate and the third supporting plate is arranged between the second supporting plate and the third supporting plate by one end thereof fixed to the second supporting plate and the other end thereof fixed to the third supporting plate.

For achieving the object, a fluorescent display tube according to the present invention is the fluorescent display tube as described above, where at least one of the supporting plates is arranged so as one end thereof is sandwiched between the anode substrate and one of the side plates which is arranged in parallel to the filament cathodes, and the other end thereof is sandwiched between the anode substrate and the other of the side plates which is arranged in parallel to the filament cathodes. At least one other of the supporting plates is arranged so as one end thereof is sandwiched between the anode substrate and one of the side plates which is arranged in parallel to the filament cathodes, and the other end thereof is provided with a supporting-plate holder. The supporting-plate holder is sandwiched between the anode substrate and the front plate.

For achieving the object, a fluorescent display tube according to the present invention is the fluorescent display tube as described above, where the first supporting plate includes an anchor member having: a base mounted on the first supporting plate; a leaf spring formed into an L-shape with the same thin sheet material as the base; and a fixing portion formed into an inverted-L-shape at a top end of the leaf spring. The second supporting plate includes a supporting member having: a fixing portion holding one end of the filament cathode at a top end thereof; and a connecting portion which connects a base body and the fixing portion of the supporting member and which is arranged with a space from the first supporting plate and the leaf spring thereof. One of the filament cathodes is arranged between the first supporting plate and the third supporting plate by one end thereof fixed to the first supporting plate and the other end thereof fixed to the third supporting plate, and the other of the filament cathodes having an equal length with the filament cathode arranged between the first supporting plate and the third supporting plate is arranged between the second supporting plate and the third supporting plate by one end thereof fixed to the second supporting plate and the other end thereof fixed to the third supporting plate, so as to arrange the plural filament cathodes in parallel.

For achieving the object, a fluorescent display tube according to the present invention is structured with: an anode substrate including an insulating substrate having phosphor segments made of electron-excited phosphors formed on the insulating substrate; a front plate; and side plates, all of which are sealed in an airtight container by low-melting-point glass, wherein filament cathodes emitting thermal electrons to excite the phosphor to emit light are provided therein. The fluorescent display tube includes: a plurality of supporting metal plates arranged inside the airtight container. The plurality of the supporting metal plates include: a first supporting metal plate; at least two second supporting metal plates arranged adjacent to the first supporting metal plate; and third supporting metal plates arranged so as to be spaced-apart from the second supporting metal plates, and the second and third supporting metal plates are same in number. At least one of the supporting metal plates is arranged so as one end thereof is sandwiched between the anode substrate and one of the side plates arranged in parallel to the filament cathode, and the other end thereof is sandwiched between the anode substrate and the other of the side plates arranged in parallel to the filament cathode. Also at least one other of the supporting metal plates is arranged so as one end thereof is sandwiched between the anode substrate and one of the side plates arranged in parallel to the filament cathode, and the other end thereof is provided with a supporting-metal-plate holder. The supporting-metal-plate holder is sandwiched between the anode substrate and the front plate. The first supporting metal plate includes an anchor member having: a base mounted on the first supporting metal plate; a leaf spring formed into an L-shape with the same thin sheet material as the base; and a fixing portion formed into an inverted-L-shape at a top end of the leaf spring. The second supporting metal plate includes a supporting member having: a fixing portion holding one end of the filament cathode at a top end thereof; and a connecting portion which connects a base body and the fixing portion of the supporting member and which is arranged with a space from the first supporting metal plate and the leaf spring thereof One of the filament cathodes is arranged between the first supporting metal plate and the third supporting metal plate by one end thereof fixed to the first supporting metal plate and the other end thereof fixed to the third supporting metal plate, and the other of the filament cathodes having an equal length with the filament cathode arranged between the first supporting metal plate and the third supporting metal plate is arranged between the second supporting metal plate and the third supporting metal plate by one end thereof fixed to the second supporting metal plate and the other end thereof fixed to the third supporting metal plate, so as to arrange the plural filament cathodes in parallel. A voltage is applied to the filament cathode via the first and second supporting metal plates.

For achieving the object, a fluorescent display tube according to the present invention is the fluorescent display tube mentioned above, in which the first supporting plate and the second supporting plates are made of metal, and in which a voltage is applied separately to each block with the filament cathodes via the first and second supporting plates.

For achieving the object, a fluorescent display tube according to the present invention is the fluorescent display tube mentioned above, in which the second supporting plates and the third supporting plates are made of metal, and in which a voltage is applied separately to each block with the filament cathodes via the second and third supporting plates.

For achieving the object, a fluorescent display tube according to the present invention is the fluorescent display tube mentioned above, in which the first supporting plate and the third supporting plates are made of metal, and in which a voltage is applied separately to each block with the filament cathodes via the first and third supporting plates.

As explained above, a fluorescent display tube according to the present invention includes filament cathodes provided in series and extended from the first supporting metal plate to the second supporting metal plate via the third supporting metal plate. Thus, the applied voltage can be more than double while reducing the current flowing through the filaments more than half compared to conventional fluorescent display tubes. Therefore, a filament power source of 3 to 8V can be applied to the fluorescent display tube with short filament length. Thus for the fluorescent display tube with one filament cathode, the filament cathode can be lighted with current of about 25 mA. As a result, the filament current can be reduced enabling easier control of turning on and off of the filaments of the fluorescent display tube. Furthermore, since lead wires for inputting electrical signal for the filament and lead wires for inputting anode signal and grid signal can be provided to different blocks, easier layout of a circuit substrate is achieved.

DETAILED DESCRIPTION OF THE PREFERRED EMBODIMENTS

A fluorescent display tube according to the present invention includes an anode substrate, in which a conductive wiring layer segment (anode wiring layer or grid wiring layer) formed in a predetermined pattern is formed on an insulating substrate and an insulating layer having through-holes. The through-holes are positioned in correspondence with anode segments with phosphors which emit light when receiving thermal electrons. A conductive layer is laminated on each conductive wiring layer segment through the through-holes. Finally, a phosphor layer is formed on a surface of each conductive layer, and the anode substrate is formed. Mesh-like grids are provided above the anode segments forming indication pattern.

A frame including the filament cathodes, supporting-plate holders, lead wires, getters and other metal components is assembled in a separate process. A box-shaped container is assembled with a front plate and side plates adhered by low-melting-point glass. An envelope is assembled by first placing the side plates of the container at periphery of the anode substrate coated with low-melting-point glass, then pressing the anode substrate and the container from up and down side, sealing the container at temperature of 500° C. or below. Then, the envelope is made to high-vacuum state by exhausting gas therefrom, forming the fluorescent display tube.

First Embodiment

Figure 1:
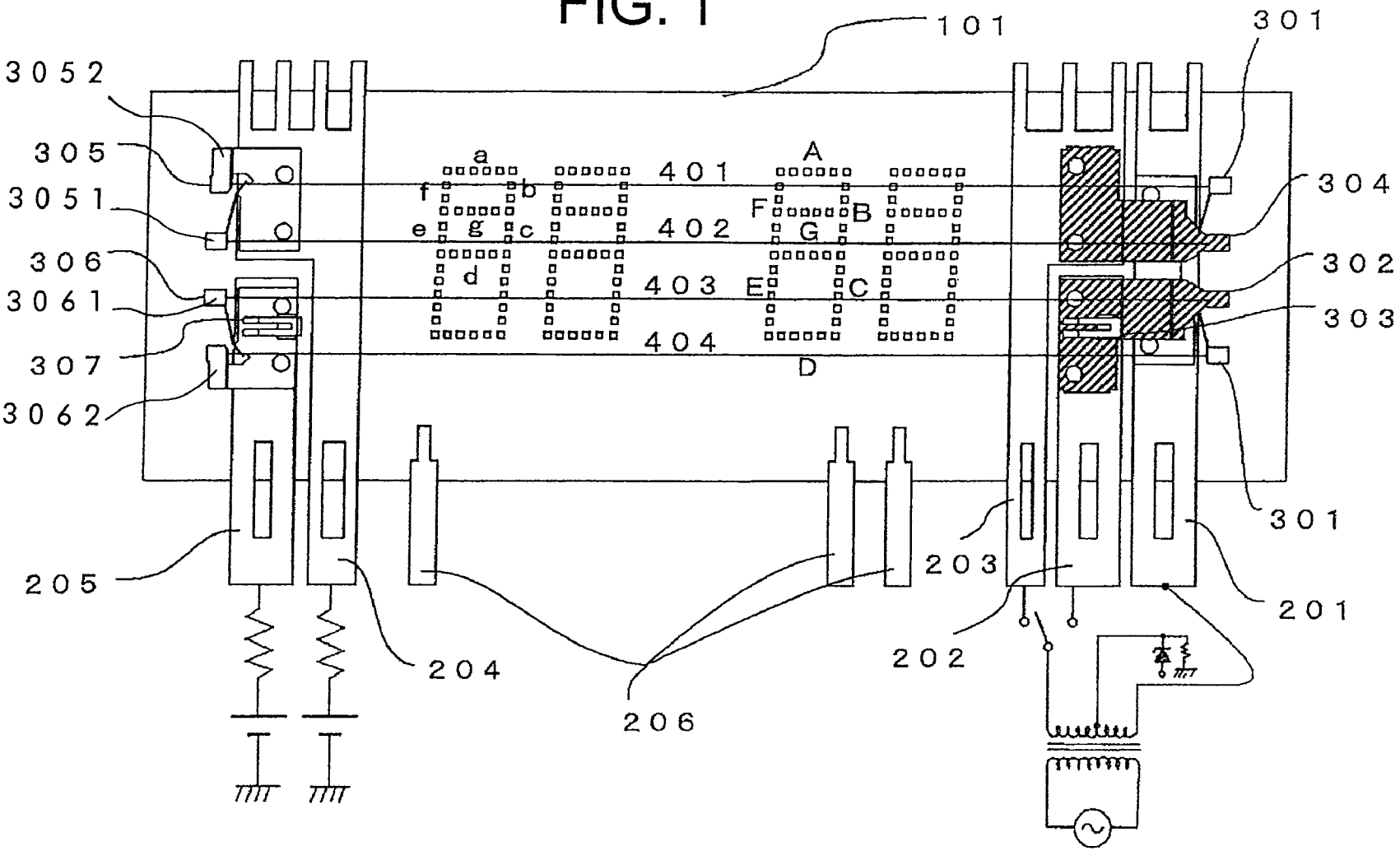
FIG. 1 is a front view of a first embodiment according to the present invention.
Figure 2:
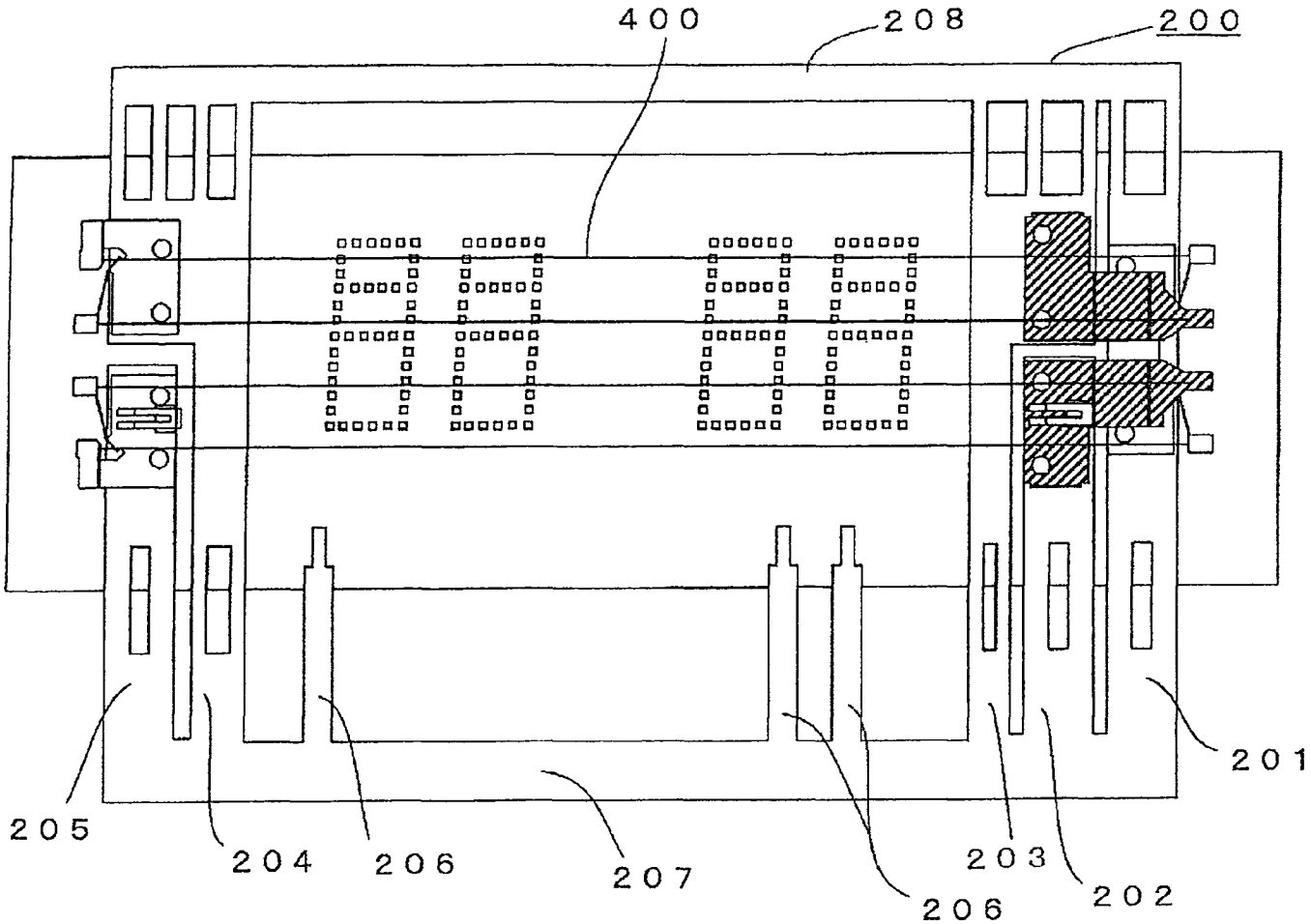
FIG. 2 is another front view of the first embodiment according to the invention.
Figure 3:
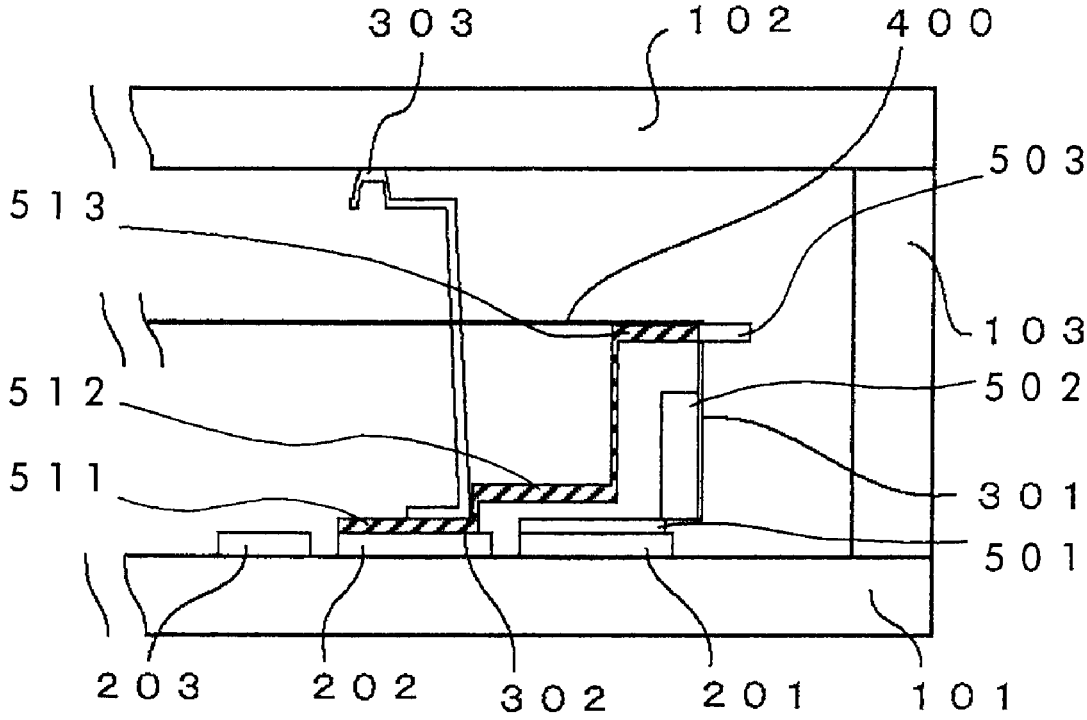
FIG. 3 is a side view of the first embodiment according to the invention seen from a lead side.
Figure 4:
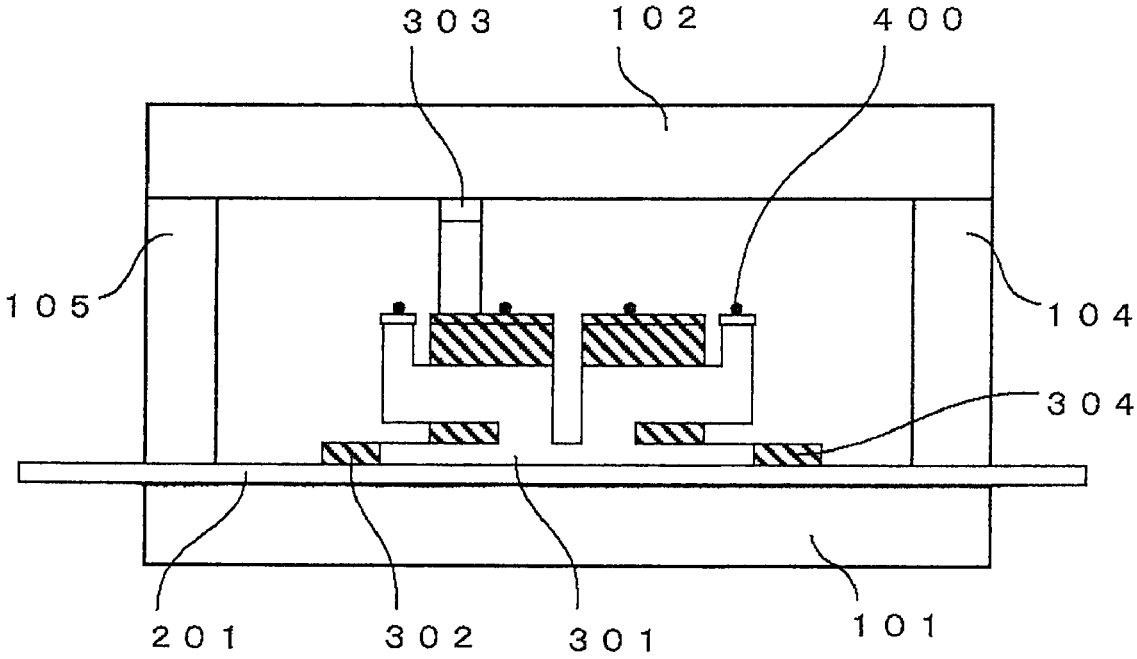
FIG. 4 is a side view of the first embodiment according to the invention seen from a right-hand side of the front view of FIG. 1.

A first embodiment of the present invention is explained with reference to the FIGS. 1 to 4. FIG. 1 shows a schematic view of the first embodiment of a fluorescent display tube according to the present invention, and FIG. 2 shows a frame according to the first embodiment. FIGS. 3 and 4 provide supplementary explanation of FIG. 1. A frame 200 of the first embodiment includes: a first supporting metal plate 201; second supporting metal plates 202, 203 arranged adjacent to the first supporting metal plate 201; and third supporting metal plates 204, 205 provided at a distance from the second supporting metal plates 202, 203. Lead wires 206 inputting an electrical signal to an anode plate and grids are provided between the second and third supporting metal plates and are connected to a connecting portion 207 shown in FIG. 2. The connecting portion 207 is connected to an opposite connecting portion 208 via the second and third supporting metal plates to form the frame 200.

The first supporting metal plate 201 is connected to the connecting portions 207, 208. The second supporting metal plate 202 is connected only to the connecting portion 207 and arranged so as to be spaced-apart from the first supporting metal plate 201. The second supporting metal plate 202 is arranged to extend from the connecting portion 207 to a mid-distance toward the connecting portion 208 but does not contact the connecting portion 208, as shown in FIG. 2. Another of the second supporting metal plates 203 is connected to both connecting portions 207, 208 and arranged to be spaced-apart from the second supporting metal plate 202. The third supporting metal plate 204 is connected to both connecting plates 207, 208, and other third supporting metal plate 205 is connected only to the connecting portion 207 and arranged to be spaced-apart from the third supporting metal plate 204. The third supporting metal plate 205 extends from the connecting portion 207 to a mid-distance toward the connecting portion 208 but does not contact the connecting portion 208, as shown in FIG. 2.

As shown in FIGS. 3 and 4, the first supporting metal plate 201 is provided with an anchor member 301 which includes: a base 501 fixed to the first supporting metal plate 201; a leaf spring 502 formed into an L-shape with the same thin sheet material as the base 501 (the L-shaped portion being a supporting point of the leaf spring 502); and fixing portion 503 formed into an inverted-L-shape at a top end of the leaf spring 502. Thus, the fixing portion 503 is arranged to be close to the side plate 104 (or 105) arranged parallel to the filament cathode 400. The leaf spring 502 is arranged to be perpendicular to the filament cathode 400. The L-shaped portion of the leaf spring 502 is arranged to be opposite of the filament cathode 400 relative to the leaf spring 502.

The second supporting metal plate 202 includes a supporting member 302 including: a fixing portion 513 retaining one end of the filament cathode 400 (403) at a top end thereof with an anchor member 3061 of the third supporting plate; and a step-like connecting portion 512 which connects a base body 511 and the fixing portion 513 and which is arranged above with a space from the leaf spring 502 of the anchor member 301 and the first supporting metal plate 201. The second supporting metal plate 202 is provided with a supporting-plate holder 303 at an end thereof distant from the connecting portion 207.

The second supporting metal plate 203 connected to the connecting portions 207, 208 includes a supporting member 304 which includes: a fixing portion holding one end of the filament cathode 400 (402) at a top end thereof through an anchor member 3051 of the third supporting metal plate; and a step-like connecting portion which connects a base body and the fixing portion and which is arranged above with a space from the leaf spring 502 of the anchor member 301 and the first supporting metal plate 201.

The third supporting metal plate 204 connected to the connecting portions 207, 208 is provided with a supporting member 3052 stretching the filament cathode 400 (401) together with the leaf spring 502 of the anchor member 301 to arrange the filament cathode to extend therebetween. A retaining member 305 includes the anchor member 3051 and the supporting member 3052. The anchor member 3051 includes: a base fixed to the third supporting metal plate 204; a leaf spring formed into an L-shape with the same thin sheet material as the base (the L-shaped portion being a supporting point of the leaf spring); and a fixing portion formed into an inverted-L-shape at a top end of the leaf spring. The supporting member 3052 includes: a fixing portion fixing the filament cathode 400; a base body; and a connecting portion connecting the fixing portion of the supporting member 3052 and the base body (the base body also functions as a base).

The third supporting metal plate 205 is connected to the connecting portion 207 with a space from the third supporting metal plate 204, and is arranged to extend from the connecting portion 207 to a mid-distance toward the connecting portion 208 but does not contact the supporting plate 208, as shown in FIG. 2. The third supporting metal plate 205 includes a retaining member 306 at an end thereof which includes the anchor member 3061 and a supporting member 3062. The supporting member 3062 includes: a fixing portion holding one end of the filament cathode 400 (404) at a top end thereof with the anchor member 301 having a connecting portion connecting a base body and the fixing portion which is arranged above and with a space from the leaf spring of the retaining member 305 and the third supporting metal plate 204. Also, the anchor member 3061 has: a leaf spring formed into an L-shape with the same thin sheet material as a base fixed to the third supporting metal plate 205 (the L-shaped portion being a supporting point of the leaf spring); and the fixing portion formed into an inverted-L-shape at a top end of the leaf spring. The third supporting metal plate 205 is provided with a supporting-plate holder 307 at the end thereof distant from the connecting portion 207.

The fluorescent display tube according to the present invention is prepared with: the frame 200 according to the first embodiment of the invention; the anode substrate 101; and a box-shaped container constructed of a front plate 102 and side plates 103, 104, 105, all of which sealed to form an airtight envelope with low-melting-point glass.

FIG. 3 shows a side view of the first and second supporting metal plates 201, 202, 203 of the fluorescent display tube according to the first embodiment of the present invention seen from side of lead wires 206 (lower side of FIG. 1). FIG. 4 shows a side view of the first and second supporting metal plates 201, 202, 203 according to the first embodiment seen from right-hand side of FIG. 1.

Since the supporting member 302 provided on the second supporting metal plate 202 is arranged so as to be spaced-apart from both the first supporting metal plate 201 and the anchor member 301, and since the supporting-plate holder 303 is provided at the end of the second supporting metal plate 202, the supporting member 302 does not deform even when the filament cathode is stretched (extended) and fixed thereto. The supporting-plate holders also functions as a shielding electrode contact lead wire when transparent conductive coating is formed onto an inner surface of the front plate 102 to act as a shield from external electric field.

Driving operation of the fluorescent display tube according to the above-described first embodiment is explained hereinafter. When a voltage for driving filament cathodes (a filament voltage) is applied between the first supporting metal plate 201 and the second supporting metal plate 203, the filament voltage is applied via the third supporting metal plate 204. In this case, the fluorescent display tube according to the first embodiment is driven by the filament cathodes 401 and 402 which are connected in series via the third supporting metal plate 204. Consequently, a length of the filament cathode is doubled, and the phosphor segments within one block (a, b, c, d, e, f and g) emit light by only one flow of current, that is, practically by only one filament cathode.

When the voltage is applied between the first supporting metal plate 201 and the second supporting metal plates 202, 203 the voltage is applied from the first supporting metal plate 201 to the second supporting metal plate 202 via the third supporting metal plate 205. Also, the voltage is applied from the first supporting metal plate 201 to the second supporting metal plate 203 via the third supporting metal plate 204. Consequently, the filament cathodes 401, 402, 403 and 404 can be driven. Therefore, a length of the filament cathode is doubled, and the phosphor segments within one block (A, B, C, D, E, F and G) emit light by two flows of current. Furthermore, when applying a direct voltage to the third supporting metal plates 204 and 205 via a resistance, a space between the phosphor segments and the third supporting metal plates 204, 205 can be reduced.

For example, if the voltage is applied between the first supporting metal plate 201 and the third supporting metal plate 204, only the filament cathode 401 lights up. If the voltage is applied between the second supporting metal plate 203 and the third supporting metal plate 204, only the filament cathode 402 lights up. If the voltage is applied between the second supporting metal plate 202 and the third supporting metal plate 205, only the filament cathode 403 lights up. Also, if the voltage is applied between the first supporting metal plate 201 and the third supporting metal plate 205, only the filament cathode 404 lights up.

Second Embodiment

Figure 5:
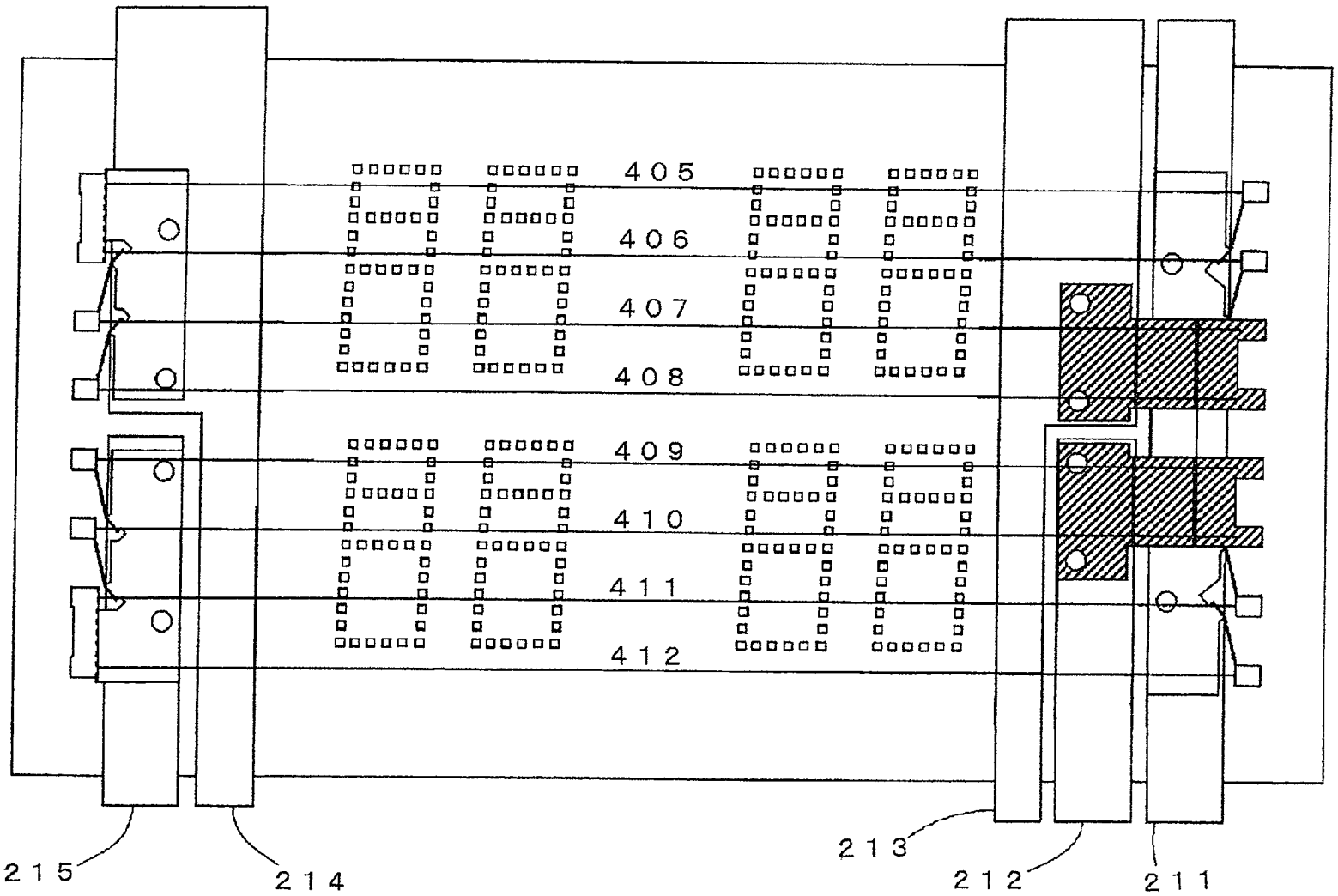
FIG. 5 is a front view of a second embodiment according to the invention.

A second embodiment of the present invention is explained with reference to the FIG. 5. FIG. 5 shows a fluorescent display tube according to the second embodiment in which two sets of phosphor segments of the first embodiment are provided in two rows as shown and in which the number of provided filament cathodes is doubled. In this embodiment, the filament cathodes of the first embodiment (401, 402 and 403, 404) are provided in parallel as shown. This fluorescent display tube of the second embodiment enables application of the voltage between the first supporting metal plate 211 and the second supporting metal plates 212, 213 via the third supporting metal plates 214, 215. In this case, the filament cathodes 405, 406 and 407, 408 are electrically connected in parallel, so the fluorescent display tube can be driven by the voltage applied from the first supporting metal plate 211 and the second supporting metal plates 213 via the third supporting metal plate 214. Consequently, the length of the filament cathode is doubled, and the phosphor segments of upper row (correspond to A, B, C, D, E, F, G in FIG. 1) emit light by two flows of current.

For example, for the fluorescent display tube according to the second embodiment shown in FIG. 5, if the voltage is applied between the first supporting metal plate 211 and the third supporting metal plate 214, only the filament cathodes 405 and 406 light-up. If the voltage is applied between the first supporting metal plate 213 and the third supporting metal plate 214, only the filament cathodes 407 and 408 light-up. If the voltage is applied between the second supporting metal plate 212 and the third supporting metal plate 215, only the filament cathodes 409 and 410 light-up. Finally, if the voltage is applied between the first supporting metal plate 211 and the third supporting metal plate 215, only the filament cathodes 411 and 412 light-up.

Third Embodiment

Figure 6:
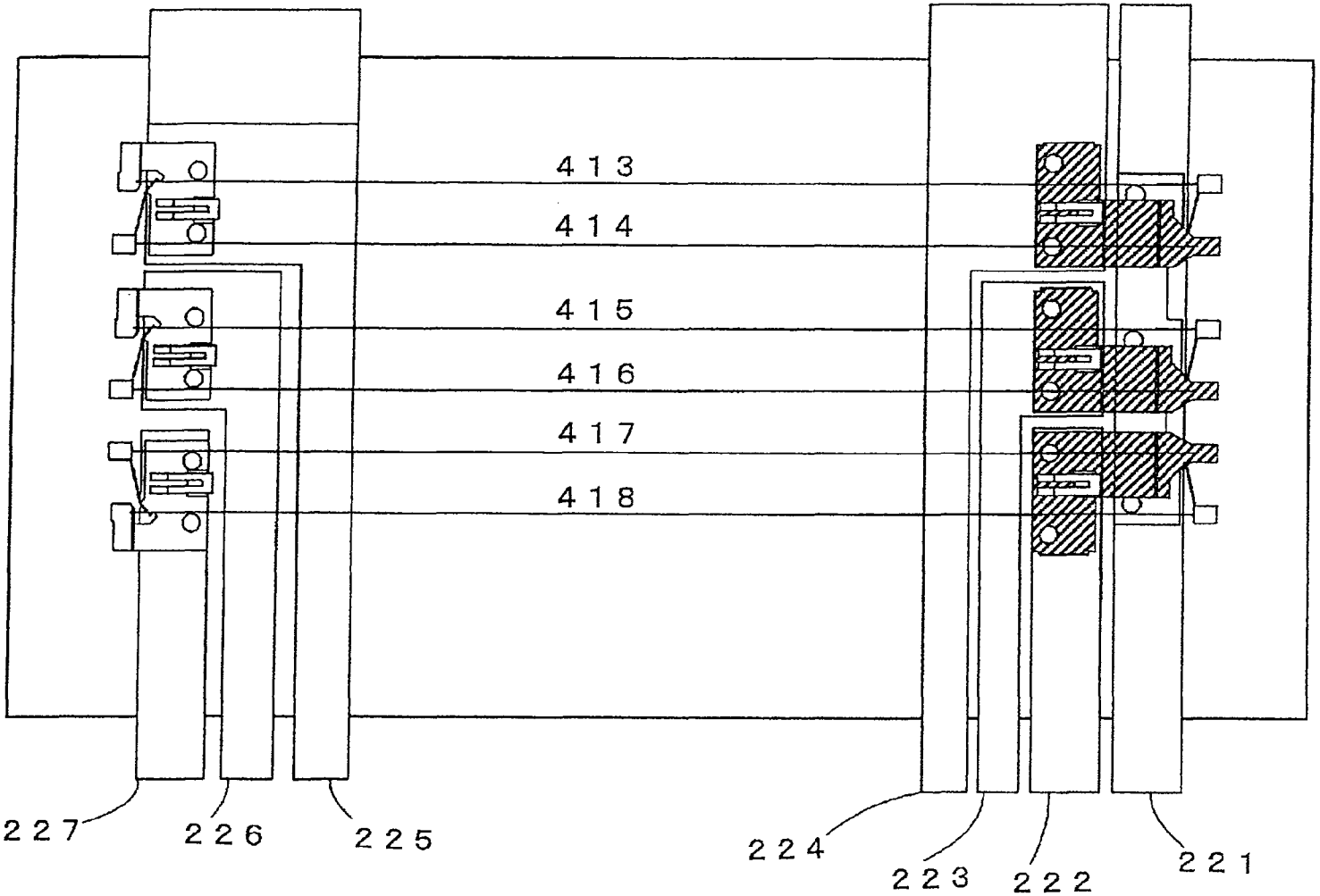
FIG. 6 is a front view of a third embodiment of the invention.
Figure 7:
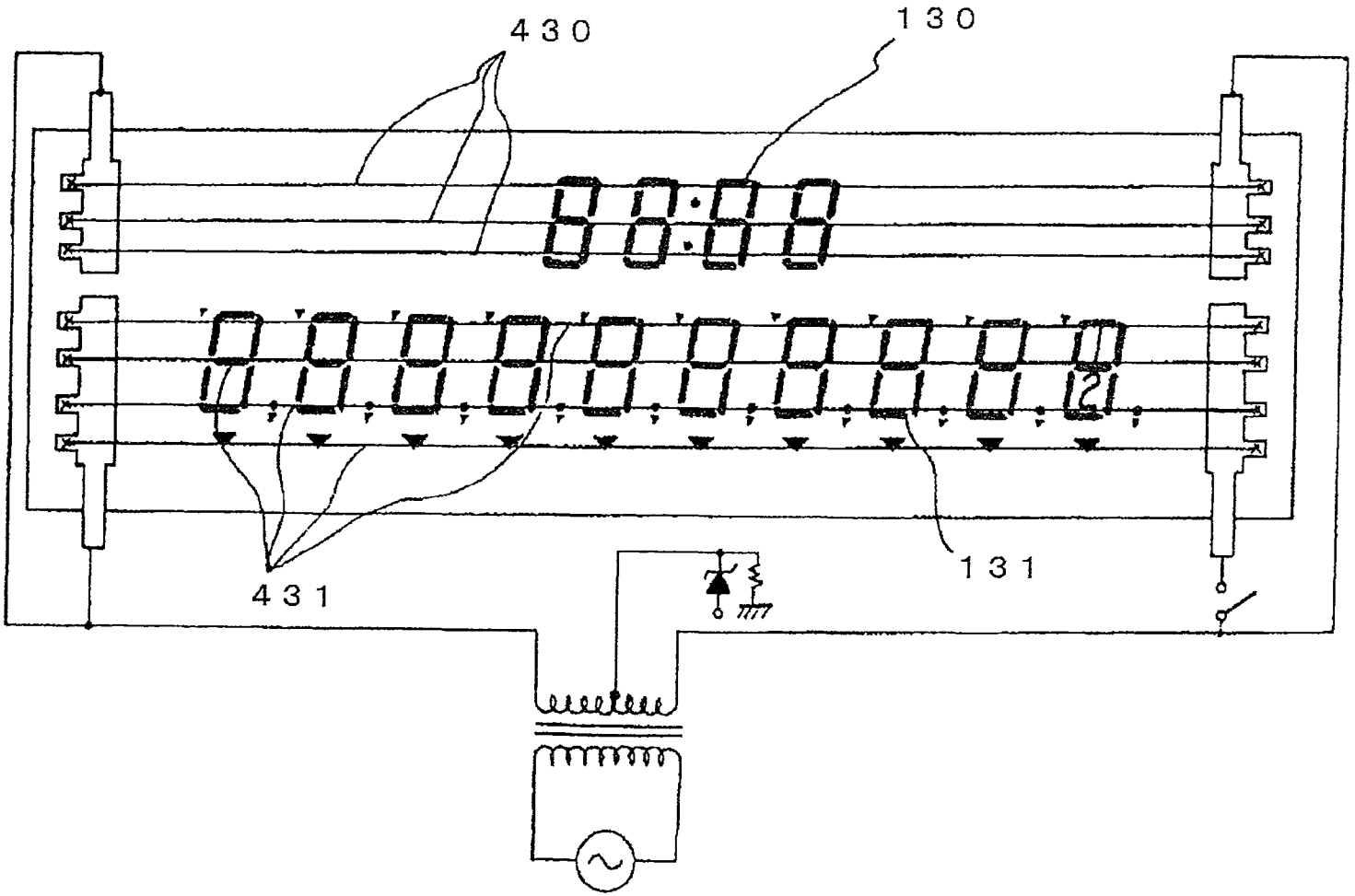
FIG. 7 PRIOR ART
FIG. 7 is a front view of a conventional fluorescent display tube by prior art.

A third embodiment of the present invention is explained with reference to the FIG. 6. FIG. 6 shows a fluorescent display tube according to the third embodiment in which three pairs (413 and 414, 415 and 416, 417 and 418) of filament cathodes of the first embodiment are provided in three rows as shown. In the fluorescent display tube according to the third embodiment, the voltage is applied between the first supporting metal plate 221 (starting zero point) and the second supporting metal plates 222, 223 and 224 (end point) via the third supporting metal plates 225, 226 and 227. Thus, the phosphor segments emit light, separately for each block, with practically one filament cathode.

For example, for the fluorescent display tube according to the third embodiment shown in FIG. 6, if the voltage is applied between the first supporting metal plate 221 and the third supporting metal plate 225, only the filament cathode 413 lights-up. If the voltage is applied between the second supporting metal plate 224 and the third supporting metal plate 225, the filament cathode 414 lights-up. If the voltage is applied between the first supporting metal plate 221 and the third supporting metal plate 226, the filament cathode 415 lights-up. If the voltage is applied between the second supporting metal plate 223 and the third supporting metal plate 226, the filament cathode 416 lights-up. If the voltage is applied between the second supporting metal plate 222 and the third supporting metal plate 227, the filament cathode 417 lights-up. If the voltage is applied between the first supporting metal plate 221 and the third supporting metal plate 227, the filament cathode 418 lights-up.

The embodiments described herein only indicate the representative embodiments, and the present invention is not limited thereto. Various changes and modifications can be made within the scope of the invention.

The invention claimed is:

1. A fluorescent display tube structured with: an anode substrate including an insulation substrate having phosphor segments made of electron-excited phosphors formed on the insulating substrate; a front plate; and side plates, all of which are sealed in an airtight container by low-melting-point glass, wherein filament cathodes emitting thermal electrons to excite the phosphors to emit light are provided therein, the fluorescent display tube comprising:

a plurality of supporting plates arranged inside the airtight container, wherein the plurality of the supporting plates include:

a first supporting plate;

at least two second supporting plates arranged adjacent to the first supporting plate; and third supporting plates arranged so as to be spaced-apart from the second supporting plates, wherein the second supporting plates and the third supporting plates being same in number, wherein one of the filament cathodes is arranged between the first supporting plate and the third supporting plate by one end thereof fixed to the first supporting plate and the other end thereof fixed to the third supporting plate, wherein the other of the filament cathodes having an equal length with the filament cathode arranged between the first supporting plate and the third supporting plate is arranged between the second supporting plate and the third supporting plate by one end thereof fixed to the second supporting plate and the other end thereof fixed to the third supporting plate.

2. A fluorescent display tube according to claim 1, wherein at least one of the supporting plates is arranged so as one end thereof is sandwiched between the anode substrate and one of the side plates which is arranged in parallel to the filament cathodes, and the other end thereof is sandwiched between the anode substrate and the other of the side plates which is arranged in parallel to the filament cathodes, wherein at least one other of the supporting plates is arranged so as one end thereof is sandwiched between the anode substrate and one of the side plates which is arranged in parallel to the filament cathodes, and the other end thereof is provided with a supporting-plate holder, wherein the supporting-plate holder is sandwiched between the anode substrate and the front plate.

3. A fluorescent display tube according to claim 2, wherein the first supporting plate includes an anchor member having: a base mounted on the first supporting plate; a leaf spring formed into an L-shape with the same thin sheet material as the base; and a fixing portion formed into an inverted-L-shape at a top end of the leaf spring, wherein the second supporting plate includes a supporting member having: a fixing portion holding one end of the filament cathode at a top end thereof; and a connecting portion which connects a base body and the fixing portion of the supporting member and which is arranged with a space from the first supporting plate and the leaf spring thereof, wherein one of the filament cathodes is arranged between the first supporting plate and the third supporting plate by one end thereof fixed to the first supporting plate and the other end thereof fixed to the third supporting plate, wherein the other of the filament cathodes having an equal length with the filament cathode arranged between the first supporting plate and the third supporting plate is arranged between the second supporting plate and the third supporting plate by one end thereof fixed to the second supporting plate and the other end thereof fixed to the third supporting plate, so as to arrange the plural filament cathodes in parallel.

4. A fluorescent display tube structured with: an anode substrate including an insulating substrate having phosphor segments made of electron-excited phosphors formed on the insulating substrate; a front plate; and side plates, all of which are sealed in an airtight container by low-melting-point glass, wherein filament cathodes emitting thermal electrons to excite the phosphor to emit light are provided therein, the fluorescent display tube comprising:

a plurality of supporting metal plates arranged inside the airtight container, wherein the plurality of the supporting metal plates include:

a first supporting metal plate;

at least two second supporting metal plates arranged adjacent to the first supporting metal plate; and third supporting metal plates arranged so as to be spaced-apart from the second supporting metal plates, wherein the second and third supporting metal plates being same in number, wherein at least one of the supporting metal plates is arranged so as one end thereof is sandwiched between the anode substrate and one of the side plates arranged in parallel to the filament cathode, and the other end thereof is sandwiched between the anode substrate and the other of the side plates arranged in parallel to the filament cathode, wherein at least one other of the supporting metal plates is arranged so as one end thereof is sandwiched between the anode substrate and one of the side plates arranged in parallel to the filament cathode, and the other end thereof is provided with a supporting-metal-plate holder, wherein the supporting-metal-plate holder is sandwiched between the anode substrate and the front plate, wherein the first supporting metal plate includes an anchor member having: a base mounted on the first supporting metal plate; a leaf spring formed into an L-shape with same thin sheet material as the base; and a fixing portion formed into an inverted-L-shape at a top end of the leaf spring, wherein the second supporting metal plate includes a supporting member having: a fixing portion holding one end of the filament cathode at a top end thereof; and a connecting portion which connects a base body and the fixing portion of the supporting member and which is arranged with a space from the first supporting metal plate and the leaf spring thereof, wherein one of the filament cathodes is arranged between the first supporting metal plate and the third supporting metal plate by one end thereof fixed to the first supporting metal plate and the other end thereof fixed to the third supporting metal plate, wherein the other of the filament cathodes having an equal length with the filament cathode arranged between the first supporting metal plate and the third supporting metal plate is arranged between the second supporting metal plate and the third supporting metal plate by one end thereof fixed to the second supporting metal plate and the other end thereof fixed to the third supporting metal plate, so as to arrange the plural filament cathodes in parallel, and wherein a voltage is applied to the filament cathode via the first and second supporting metal plates.

5. A fluorescent display tube according to claim 1, wherein the first supporting plate and the second supporting plates are made of metal, and wherein a voltage is applied separately to each block with the filament cathodes via the first and second supporting plates.

6. A fluorescent display tube according to claim 1, wherein the second supporting plates and the third supporting plates are made of metal, and wherein a voltage is applied separately to each block with the filament cathodes via the second and third supporting plates.

7. A fluorescent display tube according to claim 1, wherein the first supporting plate and the third supporting plates are made of metal, and wherein a voltage is applied separately to each block with the filament cathodes via the first and third supporting plates.

* * * * *